US010550846B2

(12) United States Patent
Hino et al.

(10) Patent No.: US 10,550,846 B2
(45) Date of Patent: Feb. 4, 2020

(54) BLOWER APPARATUS

(71) Applicant: Nidec Corporation, Kyoto (JP)

(72) Inventors: Yuko Hino, Kyoto (JP); Seung-Sin Yoo, Kyoto (JP); Tomoyuki Tsukamoto, Kyoto (JP); Akihiko Makita, Kyoto (JP)

(73) Assignee: NIDEC CORPORATION, Kyoto-shi (JP)

( * ) Notice: Subject to any disclaimer, the term of this patent is extended or adjusted under 35 U.S.C. 154(b) by 232 days.

(21) Appl. No.: 15/608,366

(22) Filed: May 30, 2017

(65) Prior Publication Data

US 2017/0356460 A1 Dec. 14, 2017

Related U.S. Application Data

(60) Provisional application No. 62/347,380, filed on Jun. 8, 2016.

(30) Foreign Application Priority Data

Mar. 15, 2017 (JP) ..... 2017-049383

(51) Int. Cl.
*F04D 17/16* (2006.01)
*F04D 29/28* (2006.01)
(Continued)

(52) U.S. Cl.
CPC ..... *F04D 17/161* (2013.01); *F01D 1/36* (2013.01); *F04D 5/001* (2013.01); *F04D 29/083* (2013.01);
(Continued)

(58) Field of Classification Search
CPC ..... F04D 17/161; F04D 5/001; F04D 29/281; F04D 29/626; F04D 29/083; F04D 25/06; F01D 1/36
See application file for complete search history.

(56) References Cited

U.S. PATENT DOCUMENTS 1,061,142 A 5/1913 Tesla
1,402,053 A * 1/1922 Dake ..... F01D 25/00 415/140
(Continued)

FOREIGN PATENT DOCUMENTS

CN 105022460 A 11/2015
JP 2008-88985 A 4/2008

OTHER PUBLICATIONS

Office Action dated Oct. 22, 2018, issued in counterpart Chinese application No. 201710444806.3, with English translation. (14 pages).
(Continued)

*Primary Examiner* — Peter J Bertheaud
(74) *Attorney, Agent, or Firm* — Westerman, Hattori, Daniels & Adrian, LLP

(57) ABSTRACT

This blower apparatus includes an air blowing portion including a plurality of flat plates; a motor portion; and a housing. The housing includes an air inlet and an air outlet. At least one of the flat plates includes an inner annular portion, an outer annular portion arranged radially outside of the inner annular portion, ribs each of which is arranged to join the inner and outer annular portions to each other, and air holes each of which is surrounded by the inner and outer annular portions and circumferentially adjacent ones of the ribs. With the inner annular portion and the outer annular portion being joined to each other through the ribs, an increase in the opening area of each air hole, which is defined between the inner and outer annular portions, can be achieved. This leads to improved air intake efficiency, resulting in improved air blowing efficiency.

11 Claims, 16 Drawing Sheets

(51) Int. Cl.

| | |
|---|---|
| ***F01D 1/36*** | (2006.01) |
| ***F04D 5/00*** | (2006.01) |
| ***F04D 29/08*** | (2006.01) |
| ***F04D 29/62*** | (2006.01) |
| *F04D 25/06* | (2006.01) |

(52) U.S. Cl.
CPC ..... *F04D 29/281* (2013.01); *F04D 29/626* (2013.01); *F04D 25/06* (2013.01)

(56) References Cited

U.S. PATENT DOCUMENTS

| | | | | |
|---|---|---|---|---|
| 2,087,834 | A * | 7/1937 | Brown | F01D 1/36 244/130 |
| 2,632,598 | A * | 3/1953 | Wales, Jr. | F04D 17/161 188/264 R |
| 5,191,247 | A * | 3/1993 | Possell | F04D 17/161 310/51 |
| 9,295,336 | B2 * | 3/2016 | Driscoll, Jr. | A47C 27/082 |
| 9,846,462 | B2 | 12/2017 | Chen et al. | |

OTHER PUBLICATIONS

Related co-pending application: U.S. Appl. No. 15/608,270, filed May 30, 2017, counterpart Japanese Patent Application No. 2017-049380.

Related co-pending application: U.S. Appl. No. 15/608,321, filed May 30, 2017, counterpart Japanese Patent Application No. 2017-049381.

Related co-pending application: U.S. Appl. No. 15/615,115, filed Jun. 6, 2017, counterpart Japanese Patent Application No. 2017-049382.

Related co-pending application: U.S. Appl. No. 15/608,446, filed May 30, 2017, counterpart Japanese Patent Application No. 2017-049384.

Related co-pending application: U.S. Appl. No. 15/608,482, filed May 30, 2017, counterpart Japanese Patent Application No. 2017-049385.

Related co-pending application: U.S. Appl. No. 15/615,143, filed Jun. 6, 2017, counterpart Japanese Patent Application No. 2017-049386.

Related co-pending application: U.S. Appl. No. 15/615,202, filed Jun. 6, 2017, counterpart Japanese Patent Application No. 2017-049387.

Related co-pending application: U.S. Appl. No. 15/615,234, filed Jun. 6, 2017, counterpart Japanese Patent Application No. 2017-049388.

Related co-pending application: U.S. Appl. No. 15/615,279, filed Jun. 6, 2017, counterpart Japanese Patent Application No. 2017-049389.

Related co-pending application: U.S. Appl. No. 15/615,316, filed Jun. 6, 2017, counterpart Japanese Patent Application No. 2017-049390.

* cited by examiner

BLOWER APPARATUS

BACKGROUND OF THE INVENTION

1. Field of the Invention

The present invention relates to a blower apparatus.

2. Description of the Related Art

A centrifugal blower apparatus which generates an air flow traveling radially outward by rotating an impeller including a plurality of blades is known. A known blower apparatus including an impeller is described in, for example, JP-A 2008-88985.

In the blower apparatus described in JP-A 2008-88985, a plurality of blades referred to as fan blades push surrounding gas to generate air flows traveling radially outward.

SUMMARY OF THE INVENTION

In recent years, there has still been a demand for reductions in the size and thickness of electronic devices. Accordingly, there has also been a demand for a reduction in the thickness of blower apparatuses used to cool the interiors of the electronic devices.

Here, in the case where an impeller is used to generate air flows, as in the blower apparatus described in JP-A 2008-88985, air flows pushed by a blade leak from axially upper and lower ends of the blade while the impeller is rotating. As a result, air pressure is lower at the axially upper and lower ends of the blade than in the vicinity of an axial middle of the blade. Accordingly, a reduction in the thickness of the blower apparatus, which involves a reduction in the axial dimension of the impeller, will result in a failure to secure sufficient air blowing efficiency.

An object of the present invention is to provide a technique for realizing a centrifugal blower apparatus which is excellent in air blowing efficiency.

A blower apparatus according to a preferred embodiment of the present invention includes an air blowing portion arranged to rotate about a central axis extending in a vertical direction; a motor portion arranged to rotate the air blowing portion; and a housing arranged to house the air blowing portion and the motor portion. The housing includes an air inlet arranged above the air blowing portion, and arranged to pass through a portion of the housing in an axial direction; and an air outlet arranged to face in a radial direction at least one circumferential position radially outside of the air blowing portion. The air blowing portion includes a plurality of flat plates arranged in the axial direction with an axial gap defined between adjacent ones of the flat plates. At least one of the flat plates includes an inner annular portion being annular, and centered on the central axis; an outer annular portion being annular, centered on the central axis, and arranged radially outside of the inner annular portion; a plurality of ribs each of which is arranged to join the inner annular portion and the outer annular portion to each other; and a plurality of air holes each of which is surrounded by the inner annular portion, the outer annular portion, and two circumferentially adjacent ones of the ribs, and is arranged to pass through the flat plate in the axial direction. Each air hole is arranged to be in communication with a space radially outside of the air blowing portion through the axial gap.

According to the above preferred embodiment of the present invention, once the air blowing portion starts rotating, an air flow traveling radially outward is generated in the axial gap between the adjacent ones of the flat plates by viscous drag of surfaces of the flat plates and a centrifugal force. Thus, gas supplied through the air inlet and the air hole travels radially outwardly of the air blowing portion. Since the air flow is generated between the flat plates, the air flow does not easily leak upwardly or downwardly, and thus, an improvement in air blowing efficiency is achieved. Moreover, with the inner annular portion and the outer annular portion being joined to each other through the ribs, an increase in the opening area of the air hole can be achieved. This leads to improved air intake efficiency, resulting in a further improvement in the air blowing efficiency. Accordingly, a reduced thickness of the blower apparatus according to the above preferred embodiment of the present invention does not result in a significant reduction in the air blowing efficiency. In addition, the blower apparatus according to the above preferred embodiment of the present invention is superior to a comparable centrifugal fan including an impeller in terms of being silent.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, blower apparatuses according to preferred embodiments of the present invention will be described. It is assumed herein that a side on which an upper plate portion is arranged with respect to a lower plate portion is an upper side, and the shape of each member or portion and relative positions of different members or portions will be described based on the above assumption. It should be noted, however, that the above definition of the upper and lower sides is not meant to restrict in any way the orientation of a blower apparatus according to any preferred embodiment of the present invention at the time of manufacture or when in use.

1. First Preferred Embodiment

1-1. Structure of Blower Apparatus

Figure 1:
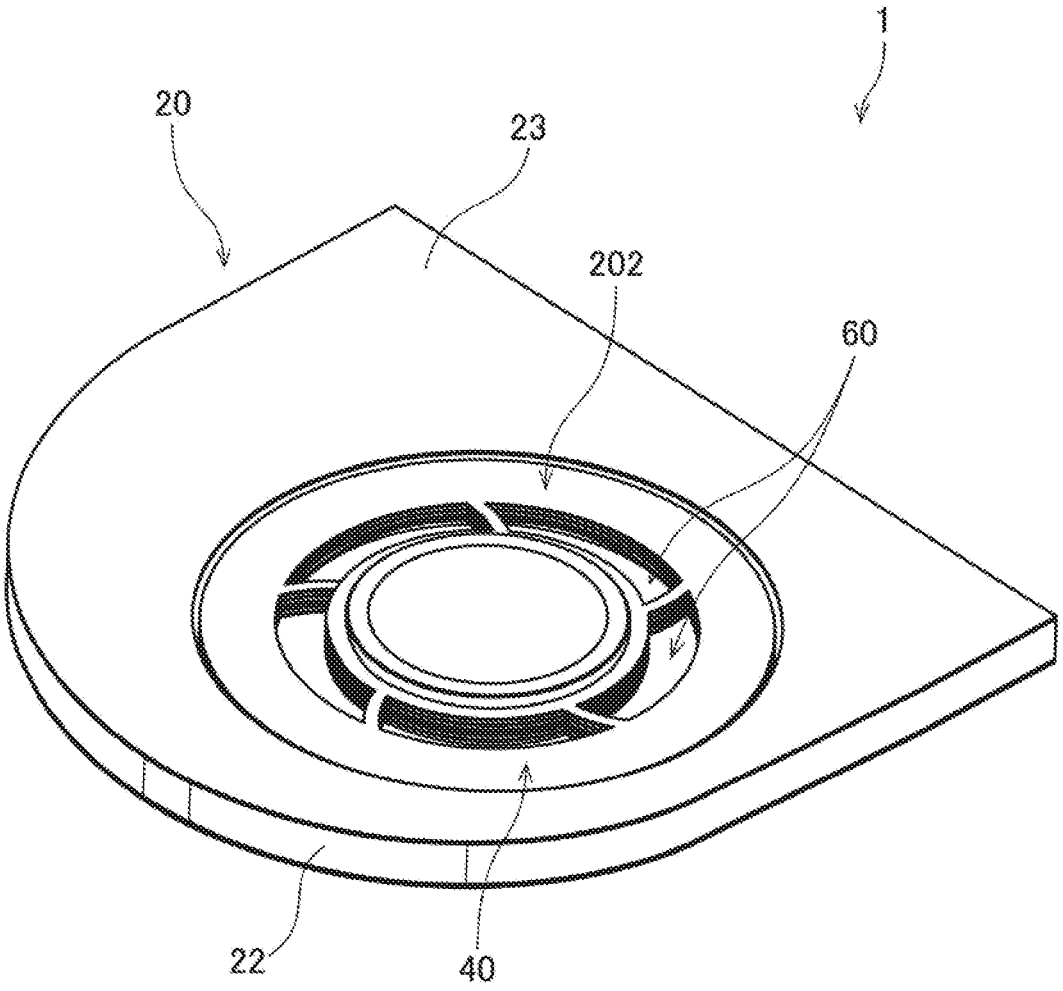
FIG. 1 is a perspective view of a blower apparatus according to a first preferred embodiment of the present invention.
Figure 2:
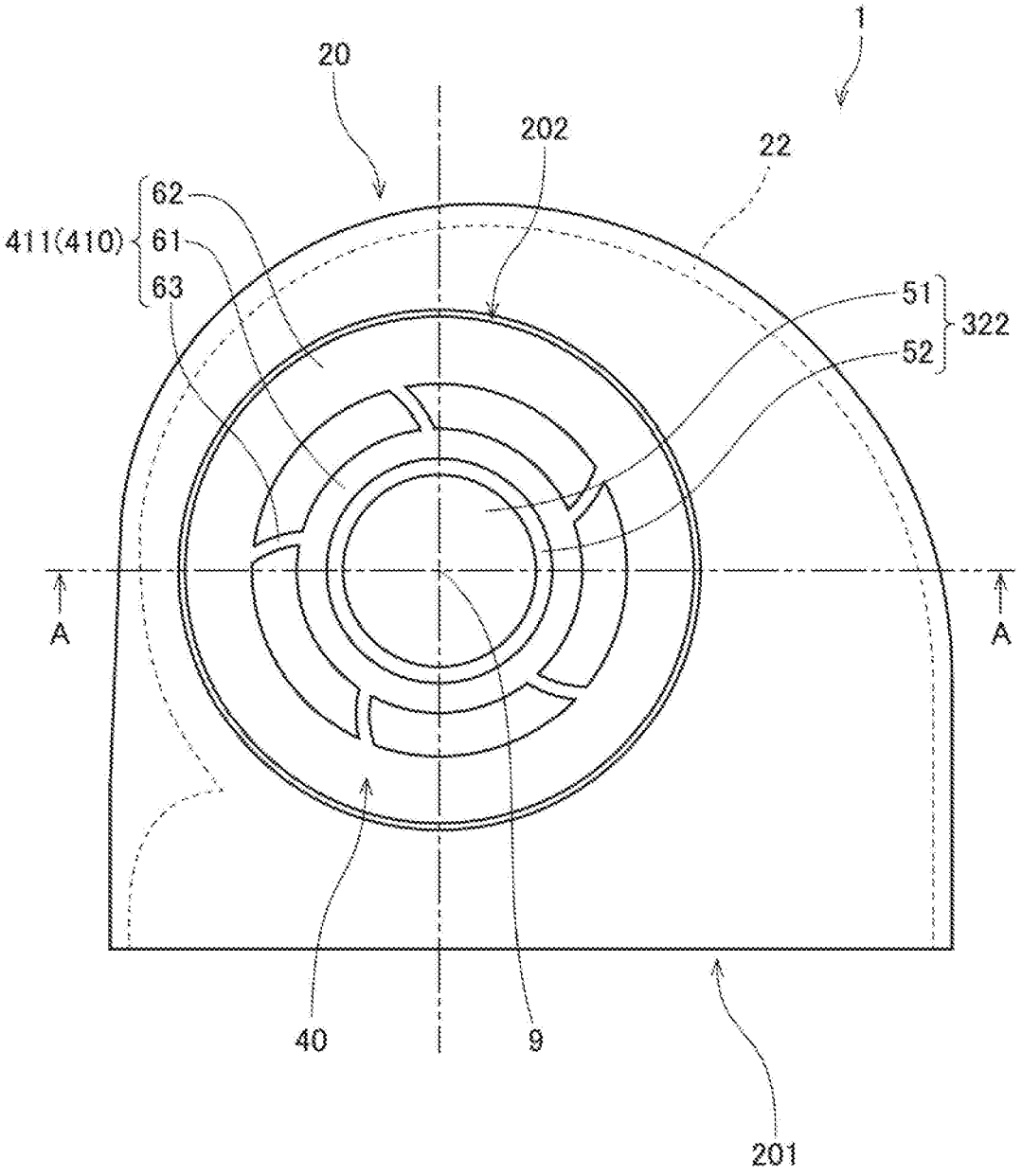
FIG. 2 is a top view of the blower apparatus according to the first preferred embodiment.
Figure 3:
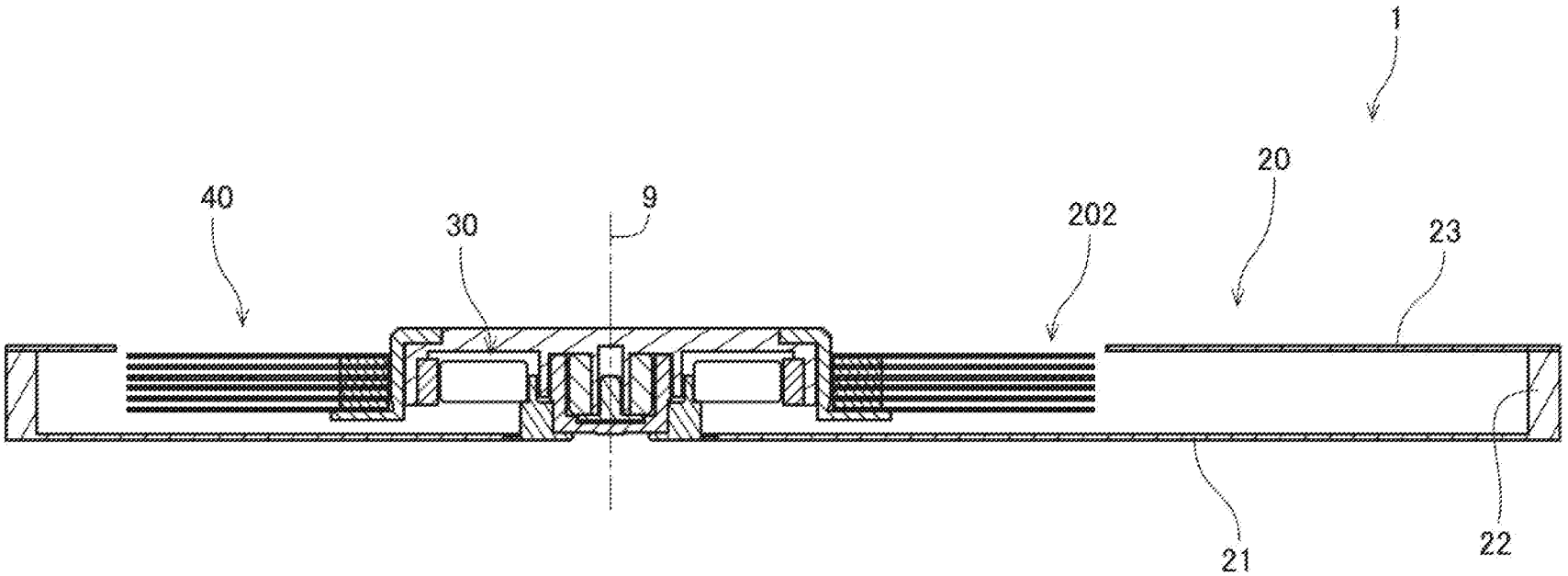
FIG. 3 is a sectional view of the blower apparatus according to the first preferred embodiment.
Figure 4:
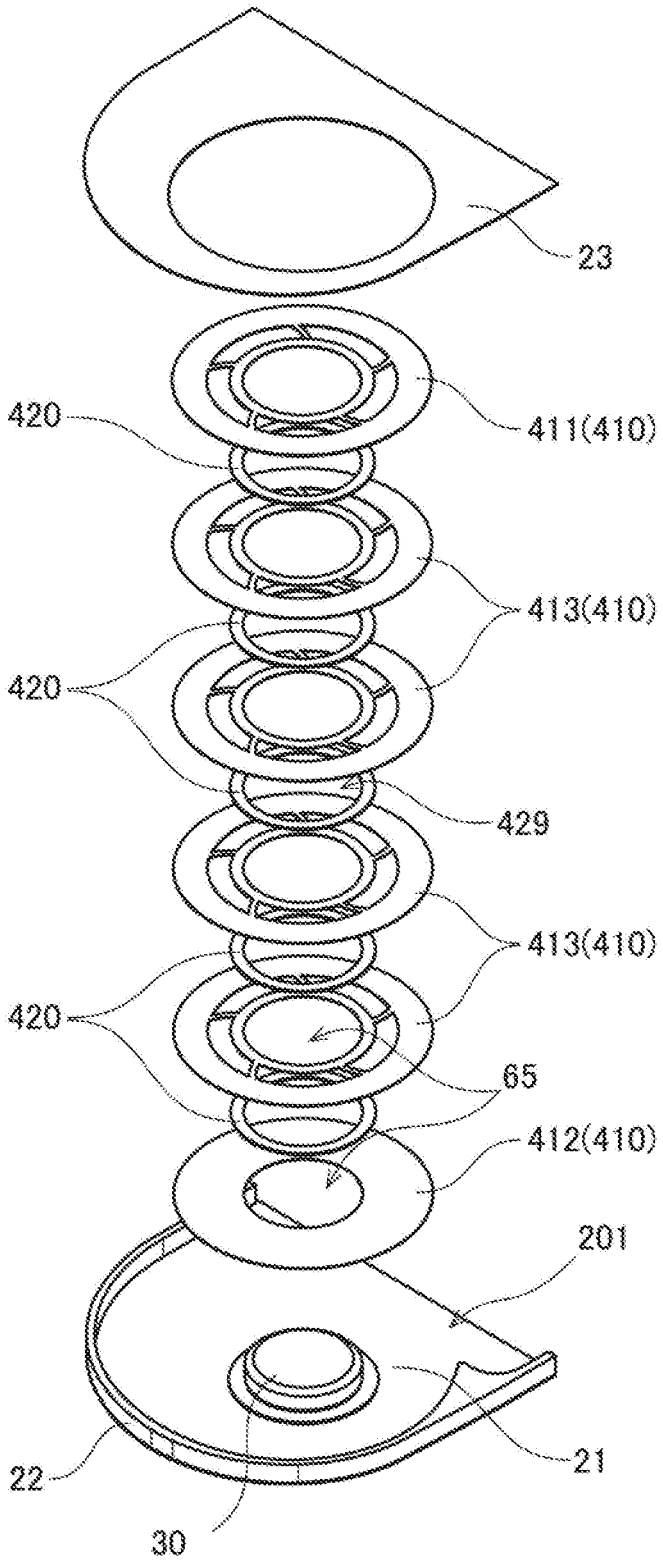
FIG. 4 is an exploded perspective view of the blower apparatus according to the first preferred embodiment.
Figure 5:
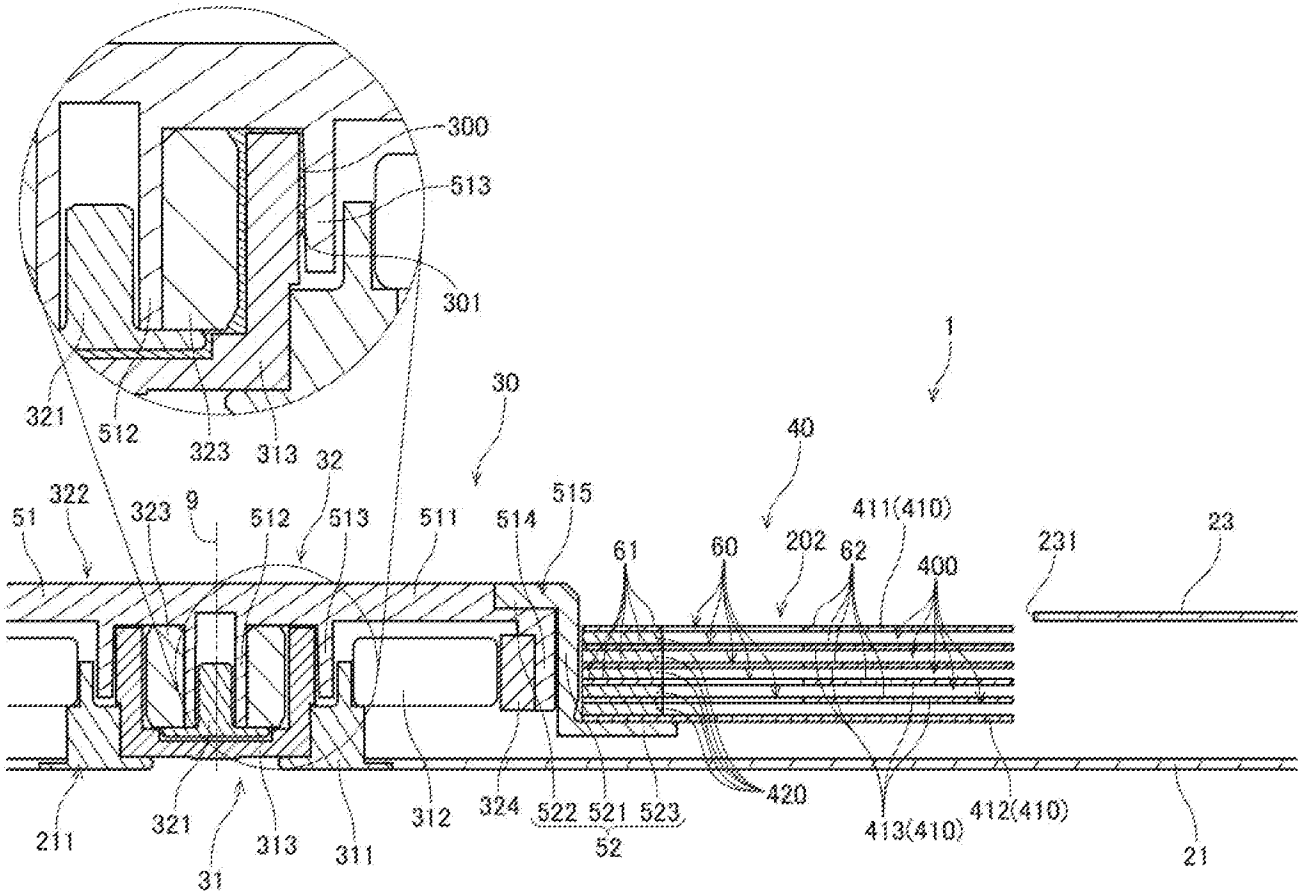
FIG. 5 is a partial sectional view of the blower apparatus according to the first preferred embodiment.

FIG. 1 is a perspective view of a blower apparatus 1 according to a first preferred embodiment of the present invention. FIG. 2 is a top view of the blower apparatus 1. FIG. 3 is a sectional view of the blower apparatus 1 taken along line A-A in FIG. 2. FIG. 4 is an exploded perspective view of the blower apparatus 1. FIG. 5 is a partial sectional view of the blower apparatus 1. The blower apparatus 1 is a centrifugal blower apparatus designed to generate an air flow traveling radially outward by rotating an air blowing portion 40. The blower apparatus 1 is, for example, installed in an electronic device, such as, for example, a personal computer, to cool an interior thereof. Note that blower apparatuses according to preferred embodiments of the present invention may be used for other purposes.

Referring to FIGS. 1 to 4, the blower apparatus 1 includes a housing 20, a motor portion 30, and the air blowing portion 40.

The housing 20 is a case arranged to house the motor portion 30 and the air blowing portion 40. The housing 20 includes a lower plate portion 21, a side wall portion 22, and an upper plate portion 23.

The lower plate portion 21 is arranged to define a bottom portion of the housing 20. The lower plate portion 21 is arranged to extend radially below the air blowing portion 40 to cover at least a portion of a lower side of the air blowing portion 40. In addition, the lower plate portion 21 is arranged to support the motor portion 30.

The side wall portion 22 is arranged to extend upward from the lower plate portion 21. The side wall portion 22 is arranged to cover a lateral side of the air blowing portion 40 between the lower plate portion 21 and the upper plate portion 23. In addition, the side wall portion 22 includes an air outlet 201 arranged to face in a radial direction at one circumferential position. In the present preferred embodiment, the lower plate portion 21 and the side wall portion 22 are defined integrally with each other. Note that the lower plate portion 21 and the side wall portion 22 may alternatively be defined by separate members.

The upper plate portion 23 is arranged to define a cover portion of the housing 20. The upper plate portion 23 is arranged to extend radially above the lower plate portion 21. In addition, the upper plate portion 23 includes an air inlet 202 arranged to pass therethrough in an axial direction. In other words, the upper plate portion 23 includes an inner edge portion 231 arranged to define the air inlet 202. The air inlet 202 is, for example, circular and is centered on a central axis 9 in a plan view.

The motor portion 30 is a driving portion arranged to rotate the air blowing portion 40. Referring to FIG. 5, the motor portion 30 includes a stationary portion 31 and a rotating portion 32. The stationary portion 31 is fixed to the lower plate portion 21. The stationary portion 31 is thus arranged to be stationary relative to the housing 20. The rotating portion 32 is supported to be rotatable about the central axis 9 with respect to the stationary portion 31.

The stationary portion 31 includes a stator fixing portion 311, a stator 312, and a bearing housing 313.

The stator fixing portion 311 is fitted in a fixing hole 211 defined in the lower plate portion 21. As a result, the stator fixing portion 311 is fixed to the lower plate portion 21. The stator fixing portion 311 is arranged to extend upward from the fixing hole 211 to assume a cylindrical shape with the central axis 9 as a center thereof. The stator 312 is fixed to an outer circumferential portion of an upper portion of the stator fixing portion 311.

The stator 312 is an armature arranged to generate magnetic flux in accordance with electric drive currents supplied from an external source. The stator 312 is arranged to annularly surround the central axis 9, which extends in a vertical direction. The stator 312 includes, for example, an annular stator core defined by laminated steel sheets, and conducting wires wound around the stator core.

The bearing housing 313 is a member being cylindrical and having a closed bottom. Specifically, the bearing housing 313 includes a disk-shaped bottom portion, and a cylindrical portion arranged to extend upward from the bottom portion. The bearing housing 313 is fixed to an inner circumferential surface of the stator fixing portion 311.

The rotating portion 32 includes a shaft 321, a hub 322, a bearing member 323, and a magnet 324.

The shaft 321 is a member arranged to extend along the central axis 9. The shaft 321 according to the present preferred embodiment includes a columnar portion arranged inside of a first cylindrical portion 512, which will be described below, and arranged to extend with the central axis 3 as a center thereof, and a disk-shaped portion arranged to extend radially from a lower end portion of the columnar portion.

The hub 322 is fixed to the shaft 321. The hub 322 is made up of a hub body member 51 and a flange member 52.

The hub body member 51 includes a first top plate portion 511, the first cylindrical portion 512, a second cylindrical portion 513, and a magnet holding portion 514.

The first top plate portion 511 is a disk-shaped portion arranged to extend radially with the central axis 9 as a center thereof. The first top plate portion 511 is arranged above the stator 312. The first top plate portion 511 has a recessed portion 515 recessed from an upper surface thereof at an outer edge portion thereof.

The first cylindrical portion 512 is arranged to extend downward from the first top plate portion 511 to assume a cylindrical shape with the central axis 9 as a center thereof. The columnar portion of the shaft 321 is housed in the first cylindrical portion 512. In addition, the shaft 321 is fixed to the first cylindrical portion 512.

The second cylindrical portion 513 is arranged to extend downward from the first top plate portion 511 to assume a cylindrical shape with the central axis 9 as a center thereof. The second cylindrical portion 513 is arranged to have an inside diameter greater than an outside diameter of the first cylindrical portion 512. In other words, the second cylindrical portion 513 is arranged radially outside of the first cylindrical portion 512.

The magnet holding portion 514 is arranged to extend downward from a radially outer end of the first top plate portion 511 to assume a cylindrical shape with the central axis 9 as a center thereof. The magnet holding portion 514 is arranged radially outside of the stator 312. The magnet 324 is fixed to an inner circumferential surface of the magnet holding portion 514.

The flange member 52 includes an outer wall portion 521, a second top plate portion 522, and a flat plate holding portion 523.

The outer wall portion 521 is a cylindrical portion arranged to extend in the vertical direction with the central axis 9 as a center thereof. The outer wall portion 521 is arranged to extend along an outer circumferential surface of the magnet holding portion 514 of the hub body member 51.

The second top plate portion 522 is arranged to extend radially inward from an upper end portion of the outer wall portion 521 to assume the shape of a circular ring. The second top plate portion 522 is arranged in the recessed portion 515, which is defined in the upper surface of the first top plate portion 511 of the hub body member 51. In addition, the upper surface of the first top plate portion 511 and an upper surface of the second top plate portion 522 are arranged at the same axial position.

The flat plate holding portion 523 is arranged to extend radially outward from a lower end portion of the outer wall portion 521. The flat plate holding portion 523 is arranged to hold the air blowing portion 40 on a radially outer side of the magnet holding portion 514 of the hub body member 51. In the present preferred embodiment, the air blowing portion 40 is mounted on an upper surface of the flat plate holding portion 523. The flat plate holding portion 523 is thus arranged to hold a plurality of flat plates 410 included in the air blowing portion 40.

The bearing member 323 is a cylindrical member arranged to extend in the vertical direction with the central axis 9 as a center thereof. The bearing member 323 is arranged to extend along an outer circumferential surface of the first cylindrical portion 512 of the hub body member 51. In addition, the bearing member 323 is fixed to the outer circumferential surface of the first cylindrical portion 512. The cylindrical portion of the bearing housing 313 is arranged radially outside of the bearing member 323 and radially inside of the second cylindrical portion 513 of the hub body member 51.

The magnet 324 is fixed to the inner circumferential surface of the magnet holding portion 514 of the hub body member 51. In addition, the magnet 324 is arranged radially outside of the stator 312. The magnet 324 according to the present preferred embodiment is in the shape of a circular ring. A radially inner surface of the magnet 324 is arranged radially opposite to the stator 312 with a slight gap therebetween. In addition, an inner circumferential surface of the magnet 324 includes north and south poles arranged to alternate with each other in a circumferential direction. Note that a plurality of magnets may be used in place of the magnet 324 in the shape of a circular ring. In the case where the plurality of magnets are used, the magnets are arranged in the circumferential direction such that north and south poles of the magnets alternate with each other.

As illustrated in an enlarged view in FIG. 5, a lubricating fluid 300 is arranged between the bearing housing 313 and a combination of the shaft 321, the bearing member 323, and the hub body member 51. A polyolester oil or a diester oil, for example, is used as the lubricating fluid 300. The shaft 321, the hub 322, and the bearing member 323 are supported to be rotatable with respect to the bearing housing 313 through the lubricating fluid 300. Thus, in the present preferred embodiment, the bearing housing 313, which is a component of the stationary portion 31, the combination of the shaft 321, the bearing member 323, and the hub body member 51, each of which is a component of the rotating portion 32, and the lubricating fluid 300 together define a fluid dynamic bearing.

A surface of the lubricating fluid 300 is defined in a seal portion 301, which is a gap between an outer circumferential surface of the bearing housing 313 and an inner circumferential surface of the second cylindrical portion 513 of the hub body member 51. In the seal portion 301, the distance between the outer circumferential surface of the bearing housing 313 and the inner circumferential surface of the second cylindrical portion 513 is arranged to increase with decreasing height. In other words, in the seal portion 301, the distance between the outer circumferential surface of the bearing housing 313 and the inner circumferential surface of the second cylindrical portion 513 is arranged to increase with increasing distance from the surface of the lubricating fluid 300. Since the radial width of the seal portion 301 thus increases with decreasing height, the lubricating fluid 300 is attracted upward in the vicinity of the surface of the lubricating fluid 300. This reduces the likelihood that the lubricating fluid 300 will leak out of the seal portion 301.

Use of the fluid dynamic bearing as a bearing mechanism that connects the stationary portion 31 and the rotating portion 32 allows the rotating portion 32 to rotate stably. Thus, the likelihood of an occurrence of an unusual sound from the motor portion 30 can be reduced.

Once electric drive currents are supplied to the stator 312 in the motor portion 30 as described above, magnetic flux is generated around the stator 312. Then, interaction between the magnetic flux of the stator 312 and magnetic flux of the magnet 324 produces a circumferential torque between the stationary portion 31 and the rotating portion 32, so that the rotating portion 32 is caused to rotate about the central axis 9 with respect to the stationary portion 31. The air blowing portion 40, which is held by the flat plate holding portion 523 of the rotating portion 32, is caused to rotate about the central axis 9 together with the rotating portion 32.

Referring to FIGS. 4 and 5, the air blowing portion 40 includes the plurality of flat plates 410 and a plurality of spacers 420. The flat plates 410 and the spacers 420 are arranged to alternate with each other in the axial direction. In addition, adjacent ones of the flat plates 410 and the spacers 420 are fixed to each other through, for example, adhesion.

Referring to FIGS. 4 and 5, in the present preferred embodiment, the flat plates 410 include a top flat plate 411, which is arranged at the highest position, a bottom flat plate 412, which is arranged at the lowest position, and four intermediate flat plates 413, which are arranged below the top flat plate 411 and above the bottom flat plate 412. That is, the number of flat plates 410 included in the air blowing portion 40 according to the present preferred embodiment is six. The flat plates 410 are arranged in the axial direction with an axial gap 400 defined between adjacent ones of the flat plates 410.

Each flat plate 410 is made of, for example, a metal material, such as stainless steel, or a resin material. Each flat plate 410 may alternatively be made of, for example, paper. In this case, paper including a glass fiber, a metal wire, or the like in addition to plant fibers may be used. The flat plate 410 is able to achieve higher dimensional accuracy when the flat plate 410 is made of a metal material than when the flat plate 410 is made of a resin material.

In the present preferred embodiment, each of the top flat plate 411 and the four intermediate flat plates 413 is arranged to have the same shape and size. Referring to FIGS. 1, 2, and 5, each of the top flat plate 411 and the intermediate flat plates 413 includes an inner annular portion 61, an outer annular portion 62, a plurality of ribs 63, and a plurality of air holes 60. In the present preferred embodiment, the number of ribs 63 and the number of air holes 60 included in each of the top flat plate 411 and the intermediate flat plates 413 are both five. Each air hole 60 is arranged to be in communication with a space radially outside of the air blowing portion 40 through the axial gap (s) 400 adjacent to the flat plate 410 including the air hole 60 on the upper and/or lower sides of the flat plate 410. Each air hole 60 is arranged at a position overlapping with the air inlet 202 of the housing 20 when viewed in the axial direction.

The bottom flat plate 412 is an annular and plate-shaped member centered on the central axis 9. The bottom flat plate 412 has a central hole 65 arranged to pass therethrough in the vertical direction in a center thereof. The shape of each flat plate 410 will be described in detail below.

Referring to FIG. 4, each spacer 420 is a member in the shape of a circular ring. The spacers 420 are arranged between the flat plates 410 to secure the axial gaps 400 between the flat plates 410. Each spacer 420 has a central hole 429 arranged to pass therethrough in the vertical direction in a center thereof. The motor portion 30 is arranged in the central holes 65, which will be described below, of the flat plates 410 and the central holes 429 of the spacers 420.

Each spacer 420 is arranged at a position axially coinciding with the inner annular portion 61 of each of the top flat plate 411 and the intermediate flat plates 413. Thus, the spacer 420 is arranged in a region in the corresponding axial gap 400, the region covering only a portion of the radial extent of the corresponding axial gap 400.

Once the motor portion 30 is driven, the air blowing portion 40 is caused to rotate together with the rotating portion 32. As a result, viscous drag of a surface of each flat plate 410 and a centrifugal force together generate an air flow traveling radially outward in the vicinity of the surface of the flat plate 410. Thus, an air flow traveling radially outward is generated in each of the axial gaps 400 between the flat plates 410. Thus, gas above the housing 20 is supplied to each axial gap 400 through the air inlet 202 of the housing 20 and the air holes 60 of the top flat plate 411 and the intermediate flat plates 413, and is discharged out of the blower apparatus 1 through the air outlet 201, which is defined in a side portion of the housing 20.

Here, each flat plate 410 is arranged to have an axial thickness of about 0.1 mm. Meanwhile, each axial gap 400 is arranged to have an axial dimension of about 0.3 mm. The axial dimension of the axial gap 400 is preferably in the range of 0.2 mm to 0.5 mm. An excessively large axial dimension of the axial gap 400 would lead to a separation between an air flow generated by a lower surface of the flat plate 410 on the upper side and an air flow generated by an upper surface of the flat plate 410 on the lower side during rotation of the air blowing portion 40. This separation could result in a failure to generate sufficient static pressure in the axial gap 400 to discharge a sufficient volume of air. Moreover, an excessively large axial dimension of the axial gap 400 would make it difficult to reduce the axial dimension of the blower apparatus 1. Accordingly, in this blower apparatus 1, the axial dimension of the axial gap 400 is arranged to be in the range of 0.2 mm to 0.5 mm. This arrangement allows the blower apparatus 1 to achieve a reduced thickness while allowing an increase in the static pressure in the axial gap 400 to discharge a sufficient volume of air.

In addition, referring to FIG. 2, the air inlet 202 is centered on the central axis 9. That is, a center of the air inlet 202 coincides with the central axis 9. Meanwhile, the air blowing portion 40 is also centered on the central axis 9. Accordingly, differences in pressure do not easily occur at different circumferential positions in the air blowing portion 40. This contributes to reducing noise. It is assumed that the term "coincide" as used here includes not only "completely coincide" but also "substantially coincide".

1-2. Shapes of Flat Plates

Figure 6:
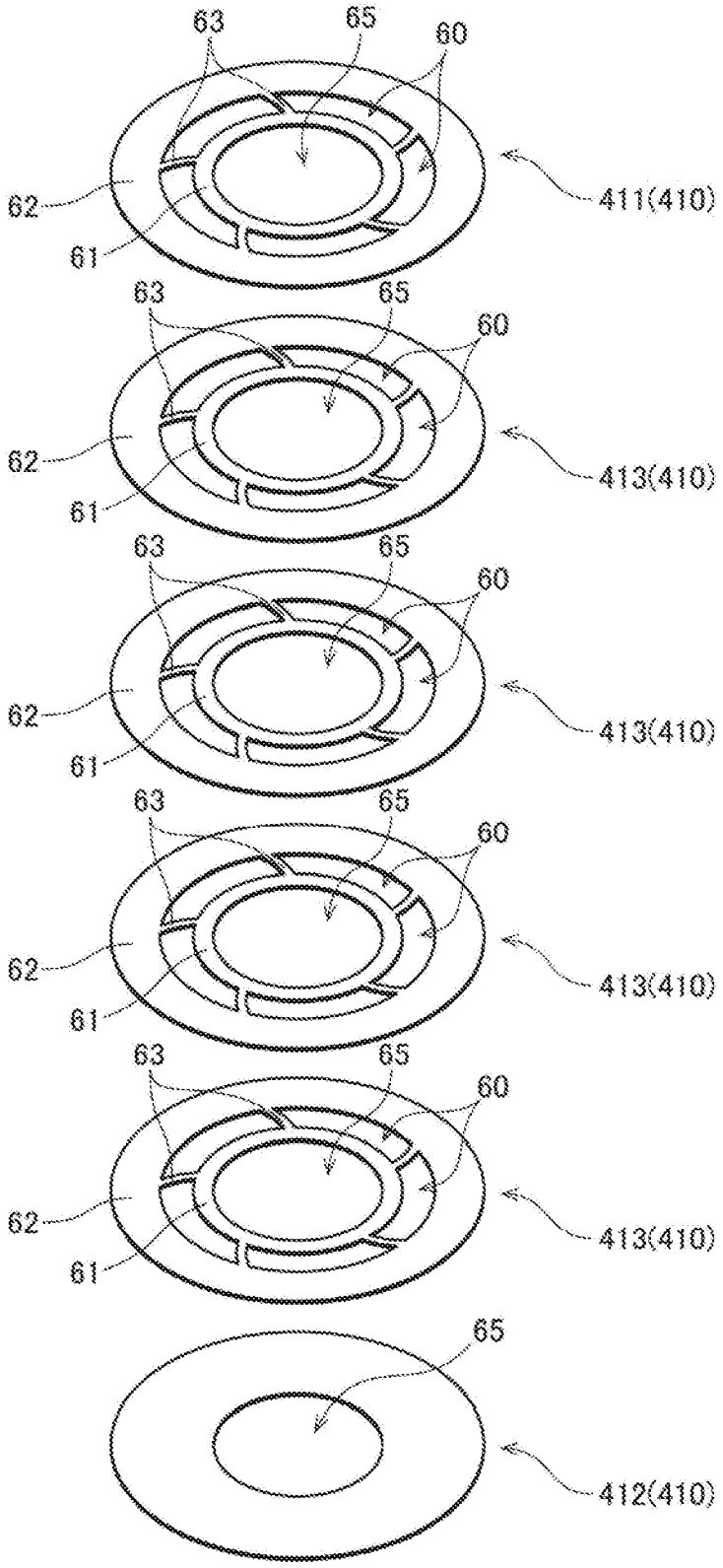
FIG. 6 is an exploded perspective view of a plurality of flat plates of the blower apparatus according to the first preferred embodiment.
Figure 7:
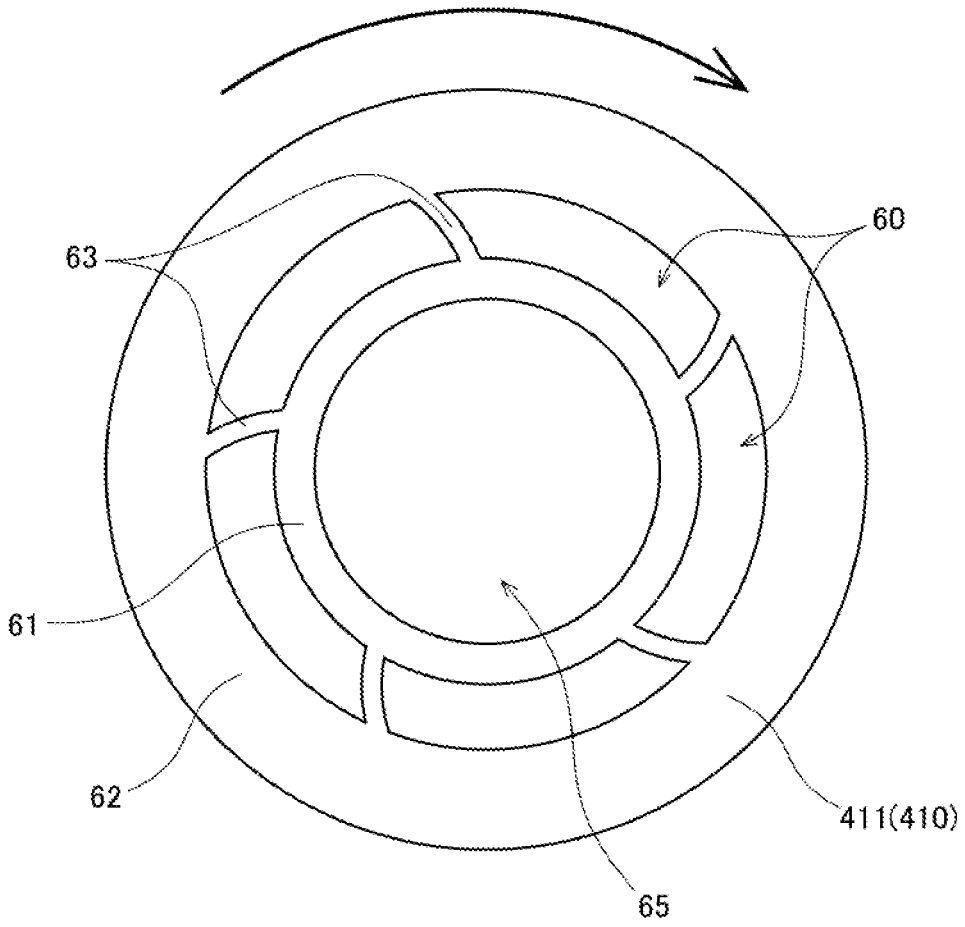
FIG. 7 is a top view of the flat plates of the blower apparatus according to the first preferred embodiment.

Next, the shape of each flat plate 410 will now be described in detail below with reference to FIGS. 6 and 7. FIG. 6 is an exploded perspective view of the flat plates 410. FIG. 7 is a top view of the flat plates 410.

Referring to FIG. 6, in the present preferred embodiment, each of the top flat plate 411 and the four intermediate flat plates 413 is arranged to have the same shape and size. As described above, each of the top flat plate 411 and the intermediate flat plates 413 includes the inner annular portion 61, the outer annular portion 62, the plurality of ribs 63, and the plurality of air holes 60.

The inner annular portion 61 is an annular portion centered on the central axis 9. The inner annular portion 61 has the central hole 65 arranged to pass therethrough in the vertical direction in the center thereof. The outer annular portion 62 is an annular portion arranged radially outside of the inner annular portion 61 with the central axis 9 as a center thereof. Each rib 63 is arranged to join the inner annular portion 61 and the outer annular portion 62 to each other. Each air hole 60 is arranged to pass through the flat plate 410 in the axial direction. Each air hole 60 is surrounded by the inner annular portion 61, the outer annular portion 62, and two circumferentially adjacent ones of the ribs 63.

In a related-art blower apparatus that generates air flows by rotating an impeller including a plurality of blades, air flows generated by the impeller leak at upper and lower end portions of the impeller. This leakage of the air flows occurs regardless of the axial dimension of the blower apparatus. Therefore, as the blower apparatus is designed to be thinner, an effect of this leakage on the blower apparatus as a whole becomes greater, resulting in lower air blowing efficiency. Meanwhile, in the blower apparatus 1 according to the present preferred embodiment, the air flows are generated in the vicinity of the surfaces of the flat plates 410, and therefore, the air flows do not easily leak upward or downward. Therefore, even when the axial dimension of the air blowing portion 40, which generates the air flows, is reduced, a reduction in air blowing efficiency due to leakages of the air flows does not easily occur. That is, even when the blower apparatus 1 has a reduced thickness, a reduction in air blowing efficiency thereof does not easily occur.

Each rib 63 is arranged to have a circumferential width smaller than a radial dimension of the rib 63. Since the inner annular portion 61 and the outer annular portion 62 are joined to each other through the ribs 63 as described above, an increase in the circumferential dimension of each air hole 60 is achieved. Thus, an increase in the opening area of the air hole 60 can be achieved without an increase in the radial dimension of the air hole 60. This leads to improved air intake efficiency/resulting in a further improvement in the air blowing efficiency of the blower apparatus 1.

In addition, in a blower apparatus including an impeller, periodic noise occurs owing to the shape, number, arrangement, and so on of blades. However, this blower apparatus 1 is superior to a comparable blower apparatus including an impeller in terms of being silent, because the air flows are generated by the viscous drag of the surface of each flat plate 410 and the centrifugal force in the blower apparatus 1.

In addition, from the viewpoint of P-Q characteristics (i.e., flow rate-static pressure characteristics), the blower apparatus 1 including the flat plates 410 is able to produce a higher static pressure in a low flow rate region than the blower apparatus including the impeller. Therefore, when compared to the blower apparatus including the impeller, the blower apparatus 1 is suitable for use in a densely packed case, from which only a relatively small volume of air can be discharged. Examples of such cases include cases of electronic devices, such as, for example, personal computers.

In the present preferred embodiment, the top flat plate 411 and all the intermediate flat plates 413 include the air holes 60. Accordingly, all the axial gaps 400 are in axial communication with a space above the housing 20 through the air inlet 202 and the air holes 60.

Each of the top flat plate 411 and the intermediate flat plates 413 includes the air holes 60. Accordingly, in each of the top flat plate 411 and the intermediate flat plates 413, the outer annular portion 62, which is arranged radially outside of the air holes 60, defines an air blowing region which generates an air flow in the vicinity of a surface thereof. Meanwhile, the bottom flat plate 412 includes no air hole 60. Therefore, in an upper surface of the bottom flat plate 412, an entire region radially outside of a portion of the bottom flat plate 412 which makes contact with the spacer 420 defines an air blowing region. In other words, in the upper surface of the bottom flat plate 412, a region which axially coincides with the air holes 60 and the ribs 63 of the top flat plate 411 and the intermediate flat plates 413, and a region which axially coincides with the outer annular portions 62 thereof, together define the air blowing region. In addition, in a lower surface of the bottom flat plate 412, an entire region radially outside of a portion of the bottom flat plate 412 which makes contact with the flat plate holding portion 523 defines an air blowing region. Notice that an air flow is generated by a lower surface of the flat plate holding portion 523 as well.

As described above, the bottom flat plate 412 has air blowing regions wider than the air blowing regions of the top flat plate 411 and the intermediate flat plates 413. Therefore, the axial gap 400 between the lowest one of the intermediate flat plates 413 and the bottom flat plate 412 is able to have higher static pressure than any other axial gap 400.

Air flows passing downward through the air inlet 202 and the air holes 60 are drawn radially outward in each axial gap 400. Therefore, the air flows passing through the air holes 60 become weaker as they travel downward. In the present preferred embodiment, the bottom flat plate 412 is arranged to have an air blowing region wider than the air blowing regions of the top flat plate 411 and the intermediate flat plates 413 to cause a stronger air flow to be generated in the lowest one of the axial gaps 400 than in any other axial gap 400 to cause the air flows passing downward through the air holes 60 to be drawn toward the lowest axial gap 400. Thus, a sufficient volume of gas is supplied to the lowest axial gap 400 as well. As a result, the air blowing portion 40 achieves improved air blowing efficiency.

Referring to FIGS. 6 and 7, in this blower apparatus 1, the ribs 63 of each of the top flat plate 411 and the four intermediate flat plates 413 are arranged at the same circumferential positions. That is, the ribs 63 of each of the top flat plate 411 and the four intermediate flat plates 413 are arranged at positions axially coinciding with the ribs 63 of every other one of the top flat plate 411 and the four intermediate flat plates 413. In addition, in each of the top flat plate 411 and the four intermediate flat plates 413, the ribs 63 are arranged at regular intervals in the circumferential direction. This allows each flat plate 410 to maintain an excellent weight balance in the circumferential direction. Thus, each of the flat plates 410 which include the ribs 63 and the air holes 60 is able to stably rotate.

In addition, as described above, the number of ribs 63 included in each of the top flat plate 411 and the four intermediate flat plates 413 is five. That is, the number of ribs 63 included in each of the top flat plate 411 and the four intermediate flat plates 413 is identical and is a prime number. Depending on the number of ribs 63, a peak of noise occurs at a different frequency corresponding to a natural frequency thereof. When the number of ribs 63 is not a prime number, peaks of noise occur at frequencies corresponding to ail divisors thereof. In this blower apparatus 1, the number of ribs 63 is a prime number, and therefore, a peak occurs only at a frequency corresponding to that number, reducing the number of peaks that occur. That is, a reduction in noise can be achieved. The number of ribs 63 included in each of the top flat plate 411 and the four intermediate flat plates 413 may alternatively be another prime number, such as, for example, seven, eleven, or thirteen.

In this blower apparatus 1, a motor with twelve poles and nine slots is used as the motor portion 30. Therefore, the number of ribs 63 included in each of the top flat plate 411 and the four intermediate flat plates 413 is prime to each of the number of slots of the motor portion 30 and the number of poles of the motor portion 30. This contributes to preventing noise that occurs due to the ribs 63 from resonating with noise that occurs due to the motor portion 30. This leads to a further reduction in noise.

In addition, in this blower apparatus 1, the flat plates 410 are caused by the motor portion 30 to rotate to one side in the circumferential direction. Referring to FIG. 7, each of the ribs 63 is arranged to curve to an opposite side in the circumferential direction as the rib 63 extends radially outward. As a result, the rib 63 extends along a direction of an air flow that passes near a surface of the flat plate 410. This contributes to preventing the rib 63 from disturbing an air flow near the flat plate 410. This leads to an improvement in the air blowing efficiency of the blower apparatus 1. Note that each rib 63 may alternatively be arranged to extend in a straight line in a radial direction, or to extend in a straight line and to be inclined to the opposite side in the circumferential direction as it extends radially outward.

2. Example Modifications

While a preferred embodiment of the present invention has been described above, it is to be understood that the present invention is not limited to the above-described preferred embodiment.

Figure 8:
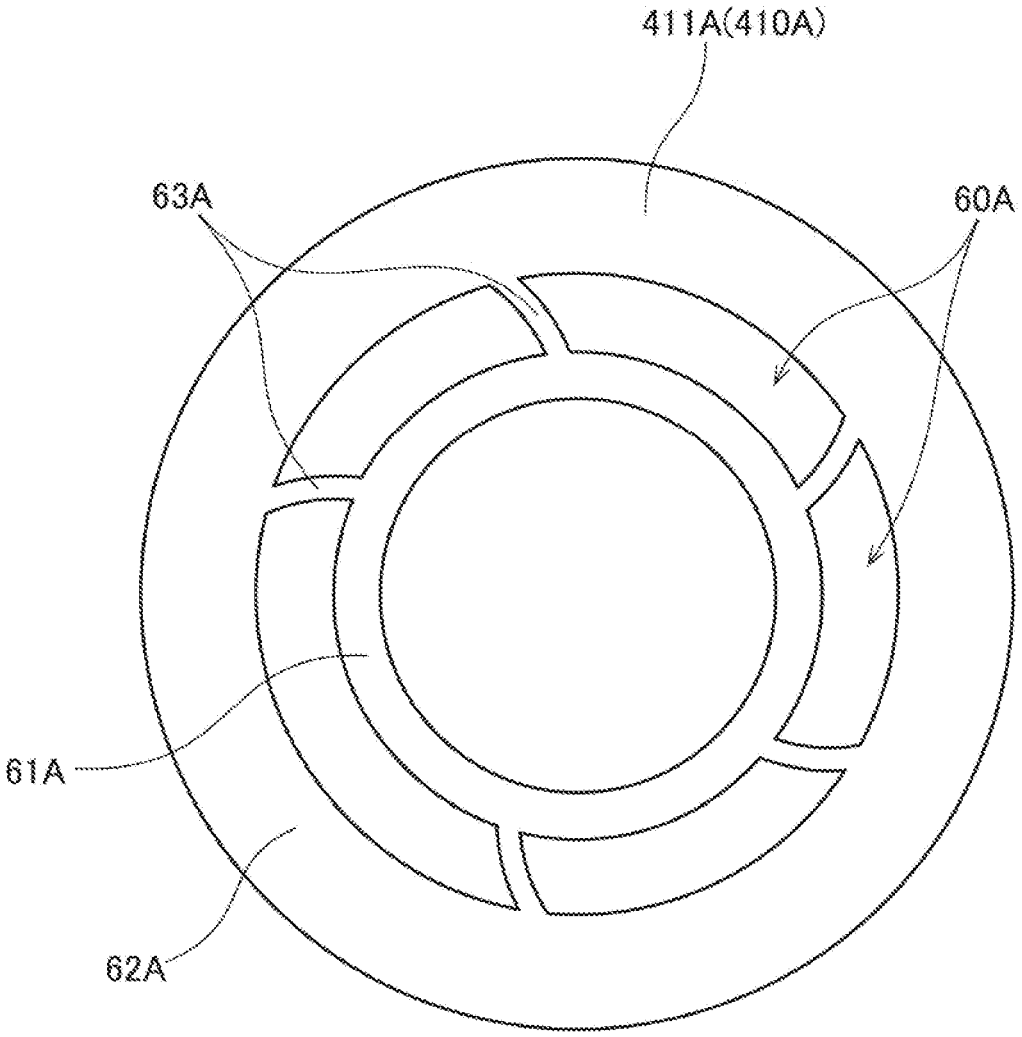
FIG. 8 is a top view of a plurality of flat plates of a blower apparatus according to a modification of the first preferred embodiment.

FIG. 8 is a top view of a plurality of flat plates 410A of a blower apparatus according to a modification of the above-described preferred embodiment. In the blower apparatus according to the modification illustrated in FIG. 8, an air blowing portion includes the plurality of flat plates 410A arranged in the axial direction with an axial gap defined between adjacent ones of the flat plates 410A, similarly to the air blowing portion 40 according to the above-described preferred embodiment. The flat plates 410A include a top flat plate 411A, which is arranged at the highest position. At least one of the flat plates 410A, including the top flat plate 411A, includes an inner annular portion 61A, which is annular, an outer annular portion 62A, which is annular, a plurality of ribs 63A, each of which is arranged to join the inner annular portion 61A and the outer annular portion 62A to each other, and a plurality of air holes 60A.

In the blower apparatus according to the modification illustrated in FIG. 8, the ribs 63A of the flat plates 410A are arranged at irregular intervals in the circumferential direction. If the ribs 63A were arranged at regular intervals in the circumferential direction, a peak of noise would occur at a frequency corresponding to a natural frequency determined by the number of ribs 63A. In the blower apparatus according to the modification illustrated in FIG. 8, the ribs 63A are arranged at irregular intervals, and this reduces the occurrence of a peak of noise. This leads to a reduction in noise.

Figure 9:
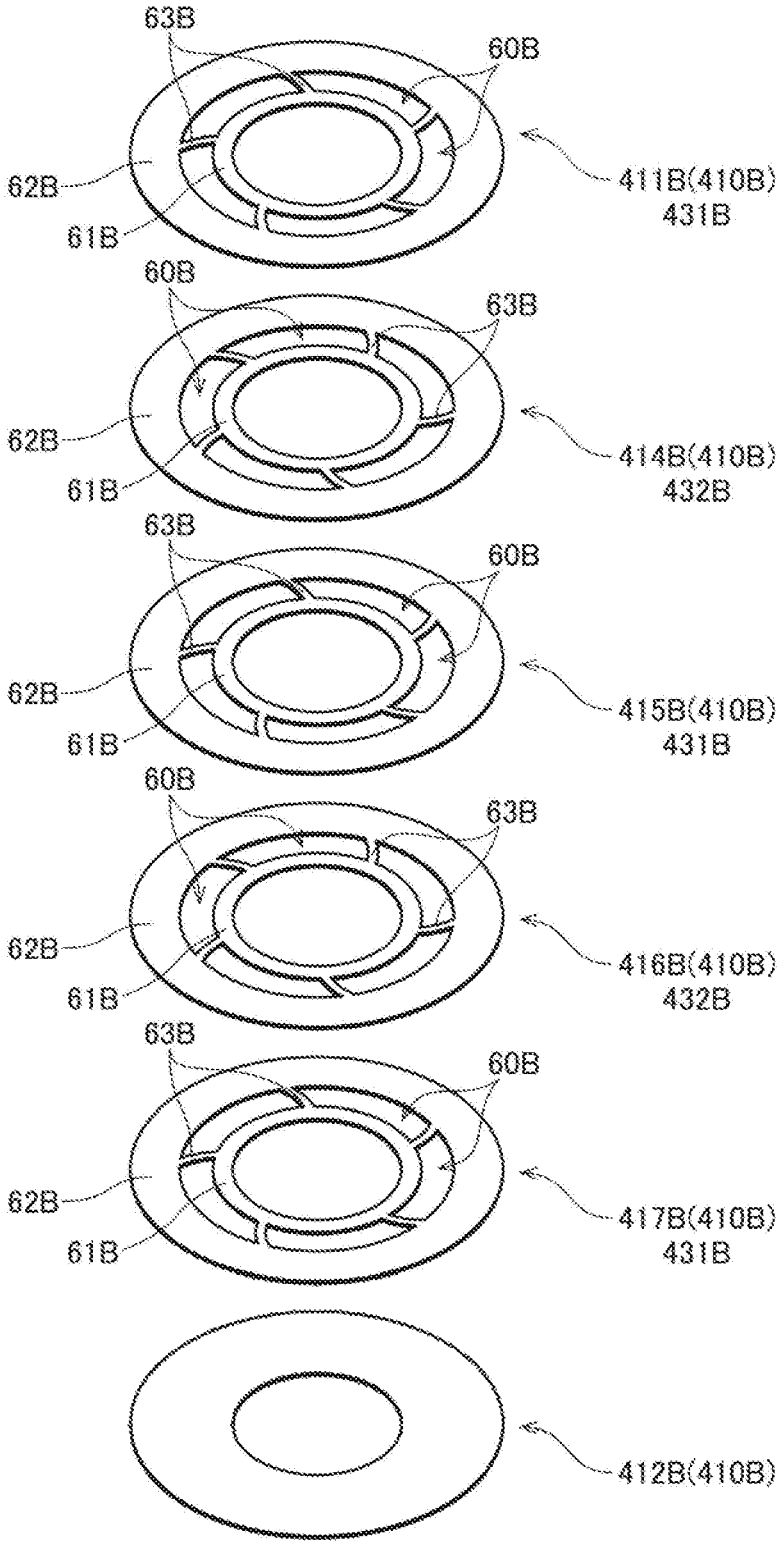
FIG. 9 is an exploded perspective view of a plurality of flat plates of a blower apparatus according to a modification of the first preferred embodiment.
Figure 10:
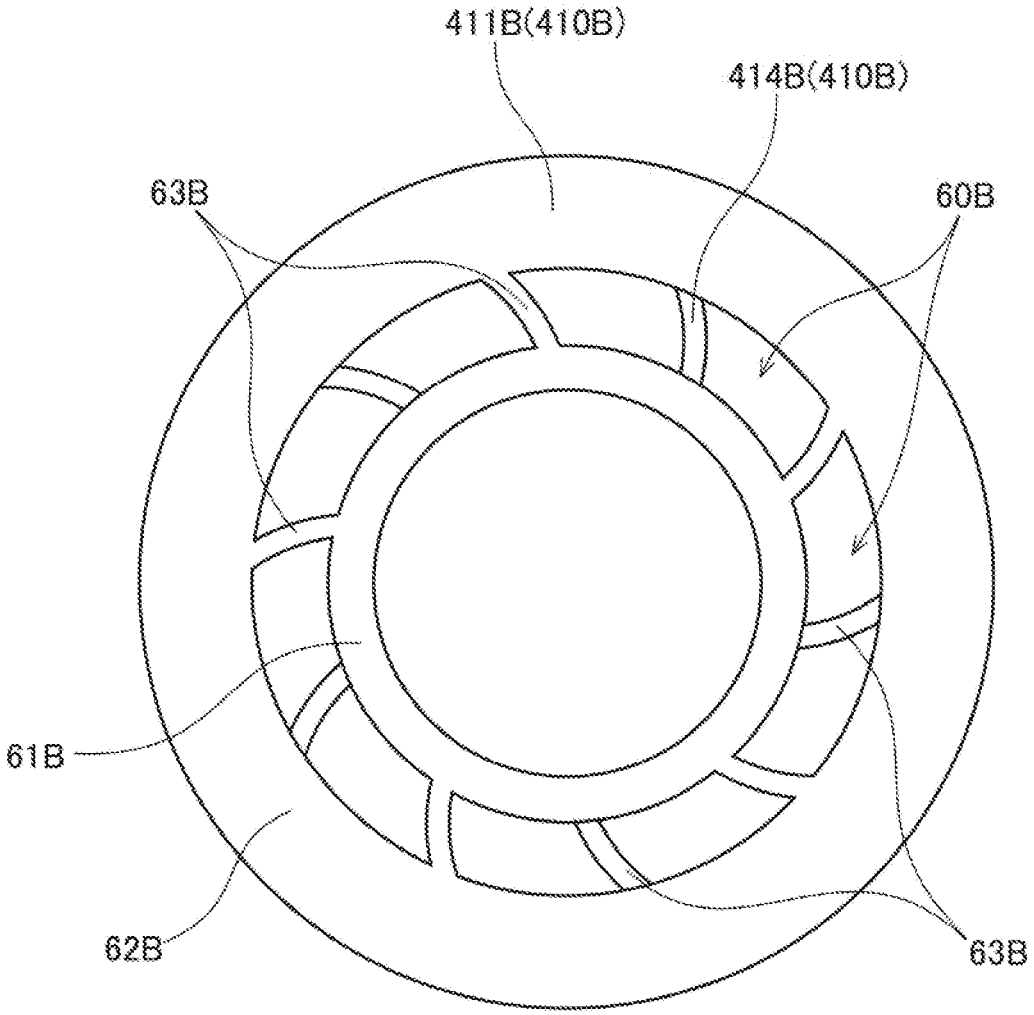
FIG. 10 is a top view of the flat plates of the blower apparatus according to a modification of the first preferred embodiment.

FIG. 9 is an exploded perspective view of a plurality of flat plates 410B of a blower apparatus according to another modification of the above-described preferred embodiment. FIG. 10 is a top view of the flat plates 410B according to the modification illustrated in FIG. 9. In the blower apparatus according to the modification illustrated in FIGS. 9 and 10, an air blowing portion includes the plurality of flat plates 410B arranged in the axial direction with an axial gap defined between adjacent ones of the flat plates 410B. The flat plates 410B include a top flat plate 411B, which is arranged at the highest position, a bottom flat plate 412B, which is arranged at the lowest position, and four intermediate flat plates 414B, 415B, 416B, and 417B, which are arranged below the top flat plate 411B and above the bottom flat plate 412B. The four intermediate flat plates 414B to 417B will be referred to as, from highest to lowest, a first intermediate flat plate 414B, a second intermediate flat plate 415B, a third intermediate flat plate 416B, and a fourth intermediate flat plate 417B. Each of the top flat plate 411B and the four intermediate flat plates 414B to 417B includes an inner annular portion 61B, which is annular, an outer annular portion 62B, which is annular, a plurality of ribs 63B, each of which is arranged to join the inner annular portion 61B and the outer annular portion 62B to each other, and a plurality of air holes 60B.

In the blower apparatus according to the modification illustrated in FIGS. 9 and 10, each of the ribs 63B of each of the above flat plates 410B and each of the ribs 63B of an axially adjacent one or ones of the above flat plates 410B are arranged at different circumferential positions. More specifically, a first flat plate group 431B includes the top flat plate 411B, the second intermediate flat plate 415B, and the fourth intermediate flat plate 417B, and the ribs 63B of each of the flat plates 410B which are included in the first flat plate group 431B are arranged at predetermined first circumferential positions. A second flat plate group 432B includes the first intermediate flat plate 414B and the third intermediate flat plate 416B, and the ribs 63B of each of the flat plates 410B which are included in the second flat plate group 432B are arranged at predetermined second circumferential positions. In addition, the flat plates 410B which are included in the first flat plate group 431B and the flat plates 410B which are included in the second flat, plate group 432B are arranged to alternate with each other in the axial direction. As described above, the five ribs 63B arranged at the first circumferential positions and the five ribs 63B arranged at the second circumferential positions are arranged at different circumferential positions. In other words, the ribs 63B of each of the flat plates 410B which are included in the first flat plate group 431B do not axially overlap with the ribs 63B of each of the flat plates 410B which are included in the second flat plate group 432B.

Referring to FIG. 10, in a plan view, the ribs 63B of each of the flat plates 410B which are included in the first flat plate group 431B and the ribs 63B of each of the flat plates 410B which are included in the second flat plate group 432B are arranged to alternate with each other in the circumferential direction. If the thickness of each flat plate 410B is reduced to reduce the thickness of the blower apparatus, rigidity of the flat plate 410B will be reduced. The flat plate 410B is particularly low in rigidity at circumferential positions at which no rib 63B is arranged. Accordingly, the ribs 63B of adjacent ones of the flat plates 410B are arranged not to overlap with each other, so that portions of the flat plates 410B which are low in rigidity are not axially adjacent to each other. This contributes to preventing a portion of any flat plate 410B which is low in rigidity from vibrating so much as to make contact with an axially adjacent one of the flat plates 410B.

Figure 11:
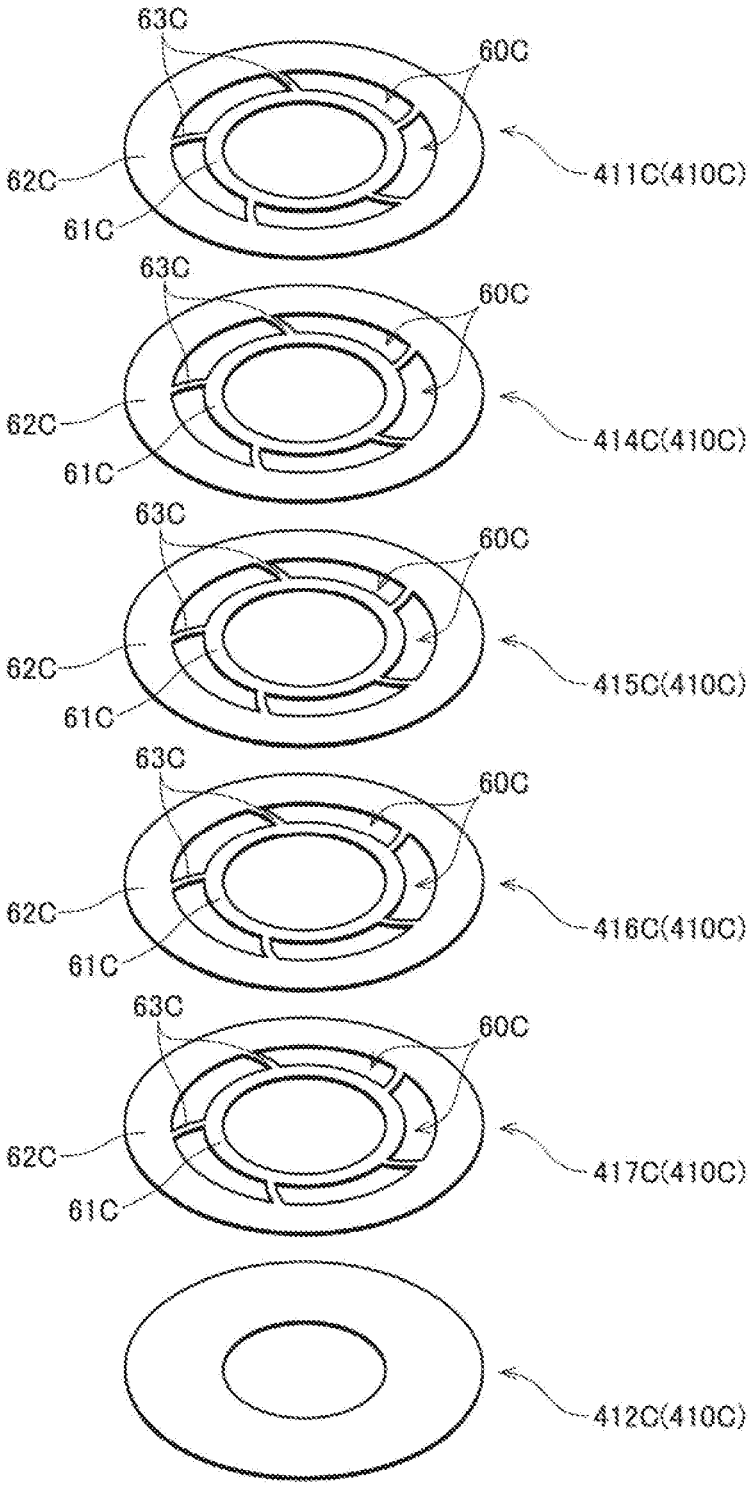
FIG. 11 is an exploded perspective view of a plurality of flat plates of a blower apparatus according to a modification of the first preferred embodiment.
Figure 12:
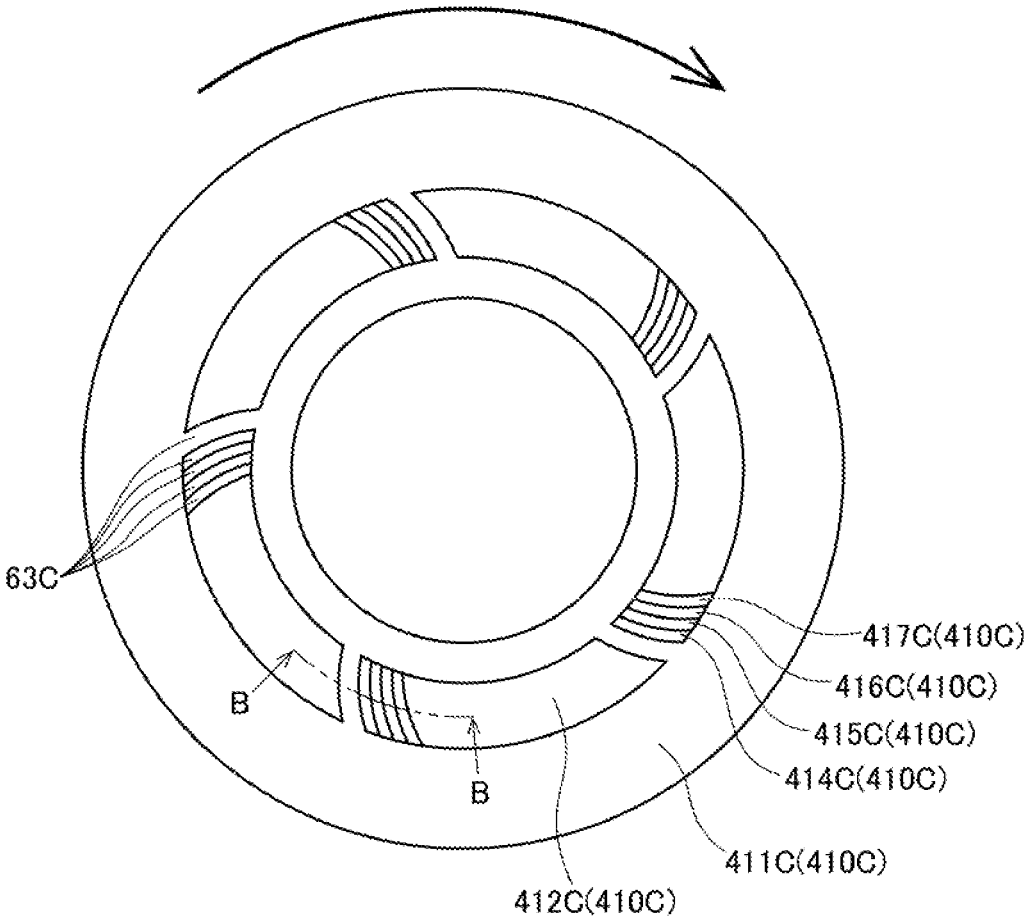
FIG. 12 is a top view of the flat plates of the blower apparatus according to a modification of the first preferred embodiment.
Figure 13:
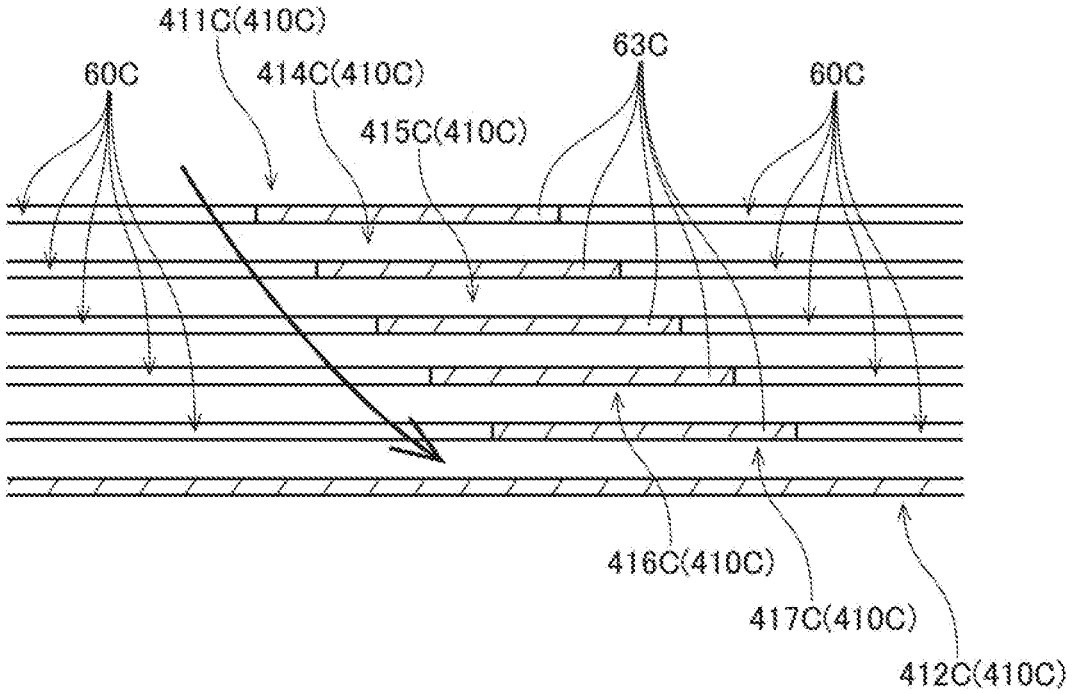
FIG. 13 is a partial sectional view of the flat plates of the blower apparatus according to a modification of the first preferred embodiment.

FIG. 11 is an exploded perspective view of a plurality of flat plates 410C of a blower apparatus according to yet another modification of the above-described preferred embodiment. FIG. 12 is a top view of the flat plates 410C according to the modification illustrated in FIG. 11. FIG. 13 is a sectional view of the flat plates 410C according to the modification illustrated in FIG. 11 taken along line B-B in FIG. 12. In the blower apparatus according to the modification illustrated in FIGS. 11 to 13, an air blowing portion includes the plurality of flat plates 410C arranged in the axial direction with an axial gap defined between adjacent ones of the flat plates 410C. The flat plates 410C include a top flat plate 411C, which is arranged at the highest position, a bottom flat plate 412C, which is arranged at the lowest position, and four intermediate flat plates 414C, 415C, 416C, and 417C, which are arranged below the top flat plate 411C and above the bottom flat plate 412C. The four intermediate flat, plates 414C to 417C will be referred to as, from highest to lowest, a first intermediate flat plate 414C, a second intermediate flat plate 415C, a third intermediate flat plate 416C, and a fourth intermediate flat plate 417C. Each of the top flat plate 411C and the four intermediate flat plates 414C to 417C includes an inner annular portion 61C, which is annular, an outer annular portion 62C, which is annular, a plurality of ribs 63G, each of which is arranged to join the inner annular portion 61C and the outer annular portion 62C to each other, and air holes 60C.

In the blower apparatus according to the modification illustrated in FIGS. 11 to 13, the flat plates 410C are caused by a motor portion to rotate to one side in the circumferential direction as indicated by an arrow in FIG. 12. That is, the air blowing portion, which includes the flat plates 410C, rotates to the one side in the circumferential direction. In addition, the ribs 63C of each of the intermediate flat plates 414C to 417C are arranged to axially overlap in part, with the corresponding ribs 63C of an upwardly adjacent one of the flat plates 410C, and are displaced to an opposite side in the circumferential direction relative to the corresponding ribs 63C of the upwardly adjacent one of the flat plates 410C.

More specifically, the ribs 63C of the first intermediate flat plate 414C are arranged to axially overlap in part with the corresponding ribs 63C of the top flat plate 411C, and are displaced to the opposite side in the circumferential direction relative to the corresponding ribs 63C of the top flat plate 411C. The ribs 63C of the second intermediate flat plate 415C are arranged to axially overlap in part with the corresponding ribs 63C of the first intermediate flat plate 414C, and are displaced to the opposite side in the circumferential direction relative to the corresponding ribs 63C of the first intermediate flat plate 414C. The ribs 63C of the third intermediate flat plate 416C are arranged to axially overlap in part with the corresponding ribs 63C of the second intermediate flat plate 415C, and are displaced to the opposite side in the circumferential direction relative to the corresponding ribs 63C of the second intermediate flat plate 415C. In addition, the ribs 63C of the fourth intermediate flat plate 417C are arranged to axially overlap in part with the corresponding ribs 63C of the third intermediate flat plate 416C, and are displaced to the opposite side in the circumferential direction relative to the corresponding ribs 63C of the third intermediate flat plate 416C.

The flat plates 410C are arranged to rotate to the one side in the circumferential direction as described above. Thus, as indicated by an arrow in FIG. 13, an air flow which travels downward through the air holes 60C of the flat plates 410C travels obliquely to the opposite side in the circumferential direction with respect to the flat plates 410C. Accordingly, since the ribs 63C are progressively displaced to the opposite side in the circumferential direction from the top flat plate 411C toward the bottom flat plate 412C, the air flow which travels downward through the air holes 60C is guided downward and to the opposite side in the circumferential direction, and the likelihood that the air flow will collide against any rib 63C is reduced. This contributes to preventing a weakening of the air flow. As a result, a sufficient volume of gas is supplied to all the axial gaps, which results in improved air blowing efficiency of the air blowing portion.

Figure 14:
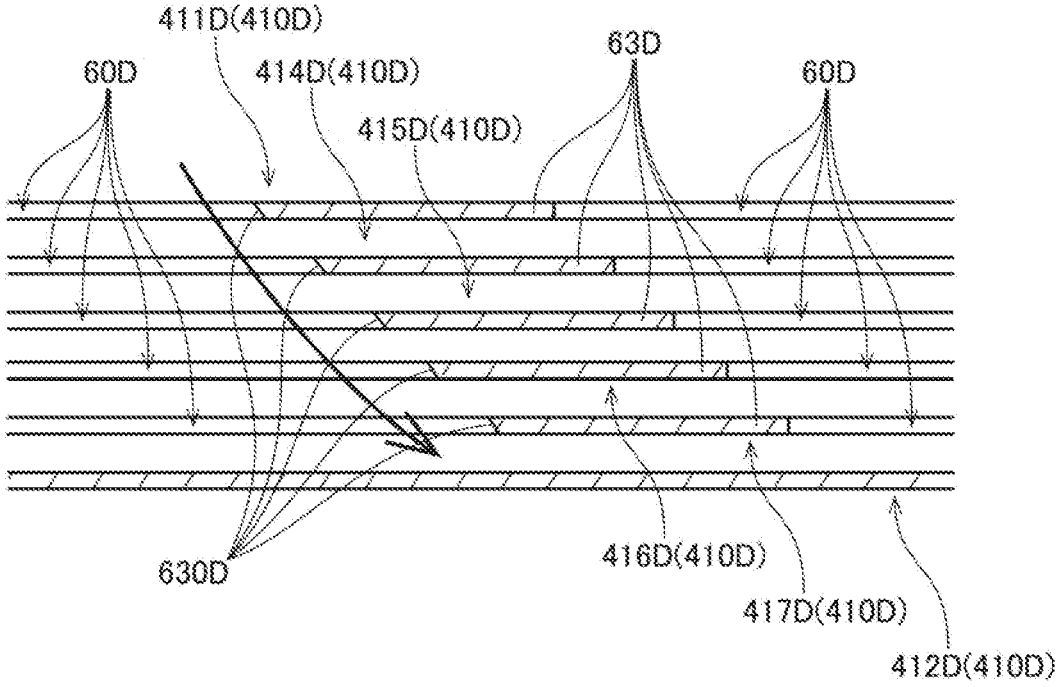
FIG. 14 is a partial sectional view of a plurality of flat plates of a blower apparatus according to a modification of the first preferred embodiment.

FIG. 14 is a sectional view of a plurality of flat plates 410D of a blower apparatus according to yet another modification of the above-described preferred embodiment. Notice that the sectional view of FIG. 14 is taken along the same line as the sectional view of FIG. 13. The flat plates 410D include a top flat plate 411D, which is arranged at the highest position, a bottom flat plate 412D, which is arranged at the lowest position, and four intermediate flat plates 414D, 415D, 416D, and 417D, which are arranged below the top flat plate 411D and above the bottom flat plate 412D. The four intermediate flat plates 414D to 417D will be referred to as, from highest to lowest, a first intermediate flat plate 414D, a second intermediate flat plate 415D, a third intermediate flat plate 416D, and a fourth intermediate flat plate 417D.

Similarly to each of the top flat plate 411C and the four intermediate flat plates 414C to 417C according to the modification illustrated in FIGS. 11 to 13, each of the top flat plate 411D and the four intermediate flat plates 414D to 417D includes an inner annular portion, which is annular, an outer annular portion, which is annular, ribs 63D, each of which is arranged to join the inner annular portion and the outer annular portion to each other, and air holes 60D. In addition, the flat plates 410D are caused by a motor portion to rotate to one side in the circumferential direction. Further, the ribs 63D of each of the intermediate flat plates 414D to 417D are displaced to an opposite side in the circumferential direction relative to the corresponding ribs 63D of an upwardly adjacent, one of the flat plates 410D.

More specifically, the ribs 63D of the first intermediate flat plate 414D are arranged to axially overlap in part with the corresponding ribs 63D of the top flat plate 411D, and are displaced to the opposite side in the circumferential direction relative to the corresponding ribs 63D of the top flat plate 411D. The ribs 63D of the second intermediate flat plate 415D are arranged to axially overlap in part with the corresponding ribs 63D of the first intermediate flat plate 414D, and are displaced to the opposite side in the circumferential direction relative to the corresponding ribs 63D of the first intermediate flat plate 414D. The ribs 63D of the third intermediate flat plate 416D are arranged to axially overlap in part with the corresponding ribs 63D of the second intermediate flat plate 415D, and are displaced to the opposite side in the circumferential direction relative to the corresponding ribs 63D of the second intermediate flat plate 415D. In addition, the ribs 63D of the fourth intermediate flat plate 417D are arranged to axially overlap in part, with the corresponding ribs 63D of the third intermediate flat plate 416D, and are displaced to the opposite side in the circumferential direction relative to the corresponding ribs 63D of the third intermediate flat plate 416D.

The flat plates 410D are arranged to rotate to the one side in the circumferential direction as described above. Thus, as indicated by an arrow in FIG. 14, an air flow which travels downward through the air holes 60D of the flat plates 410D travels obliquely to the opposite side in the circumferential direction with respect to the flat plates 410D. Accordingly, since the ribs 63D are progressively displaced to the opposite side in the circumferential direction from the top flat plate 411D toward the bottom flat plate 412D, the air flow which travels downward through the air holes 60D is guided downward and to the opposite side in the circumferential direction, and the likelihood that the air flow will collide against any rib 63D is reduced. This contributes to preventing a weakening of the air flow.

In addition, in the modification illustrated in FIG. 14, each rib 63D includes, at an edge thereof on the one side in the circumferential direction, a slanting surface 630D arranged to slant to the opposite side in the circumferential direction with decreasing height. Thus, the air flow which travels downward through the air holes 60D is more smoothly guided downward and to the opposite side in the circumferential direction. Accordingly, a sufficient volume of gas is supplied to all axial gaps, which results in improved air blowing efficiency of an air blowing portion.

Figure 15:
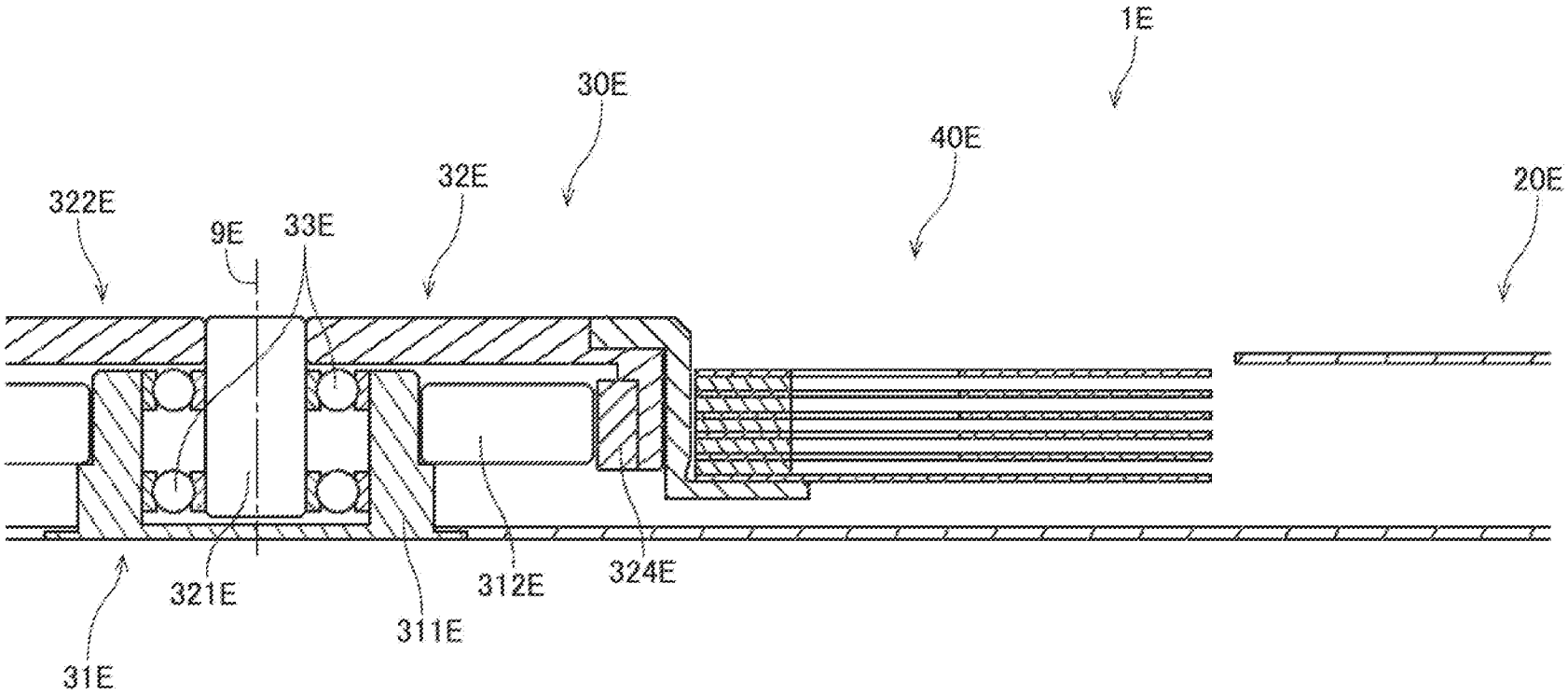
FIG. 15 is a partial sectional view of a blower apparatus according to a modification of the first preferred embodiment.

FIG. 15 is a partial sectional view of a blower apparatus 1E according to yet another modification of the above-described preferred embodiment. In the blower apparatus 1E according to the modification illustrated in FIG. 15, a motor portion 30E includes a stationary portion 31E, a rotating portion 32E, and two ball bearings 33E.

The stationary portion 31E includes a stator fixing portion 311E and a stator 312E. The stator fixing portion 311E is a member being cylindrical and having a closed bottom and fixed to a housing 20E. The stator 312E is an armature fixed to an outer circumferential surface of the stator fixing portion 311E.

The rotating portion 32E includes a shaft 321E, a hub 322E, and a magnet 324E. At least a lower end portion of the shaft 321E is arranged inside of the stator fixing portion 311E. In addition, an upper end portion of the shaft 321E is fixed to the hub 322E. The magnet 324E is fixed to the hub 322E. The magnet 324E is arranged radially opposite to the stator 312E.

Each ball bearing 33E is arranged to connect the rotating portion 32E to the stationary portion 31E such that the rotating portion 32E is rotatable with respect to the stationary portion 31E. Specifically, an outer race of each ball bearing 33E is fixed to an inner circumferential surface of the stator fixing portion 311E of the stationary portion 31E. In addition, an inner race of each ball bearing 33E is fixed to an outer circumferential surface of the shaft 321E of the rotating portion 32E. Further, a plurality of balls, each of which is a spherical rolling element, are arranged between the outer race and the inner race. As described above, instead of a fluid dynamic bearing, rolling-element bearings, such as, for example, ball bearings, may be used as a bearing structure of the motor portion 30E.

In the modification illustrated in FIG. 15, the motor portion 30E includes the two ball bearings 33E. The ball bearings 33E are arranged near an upper end and a lower end of an axial range over which the inner circumferential surface of the stator fixing portion 311E and the shaft 321E are opposed to each other. This contributes to preventing the shaft 321E from being inclined with respect to a central axis 9E.

Figure 16:
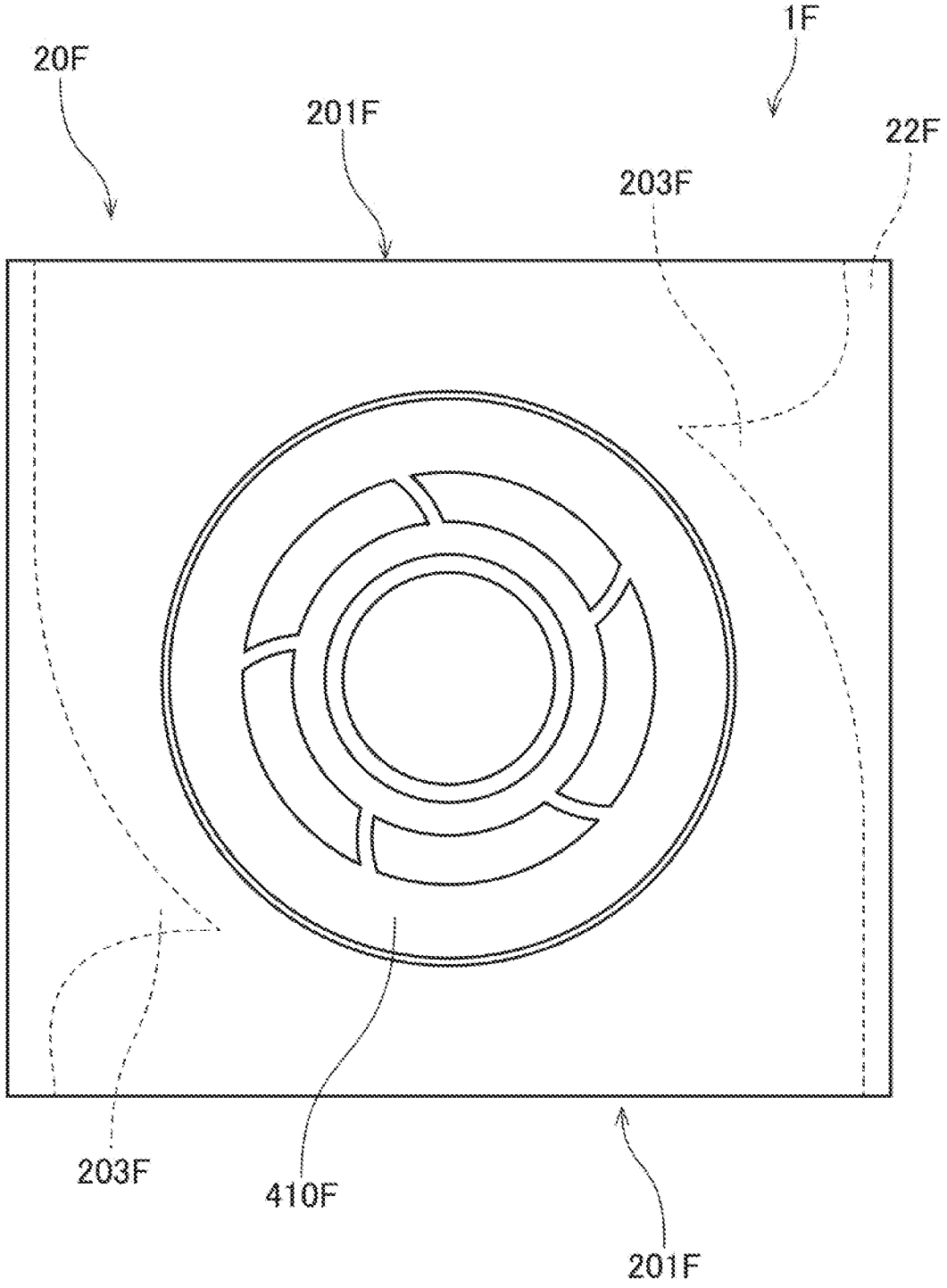
FIG. 16 is a top view of a blower apparatus according to a modification of the first preferred embodiment.

FIG. 16 is a top view of a blower apparatus 1F according to yet another modification of the above-described preferred embodiment. In the blower apparatus 1F according to the modification illustrated in FIG. 16, a housing 20F includes a plurality of air outlets 201F. Specifically, a side wall portion 22F includes the air outlets 201F, each of which is arranged to face in a radial direction, at a plurality of circumferential positions. The housing 20F includes tongue portions 203F, each of which is arranged near a separate one of the air outlets 201F. In addition, an air blowing portion 40F includes a plurality of flat plates 410F arranged in the axial direction with an axial gap defined between adjacent ones of the flat plates 410F.

In a centrifugal fan including an impeller, periodic noise occurs owing to the shape, number, arrangement, and so on of blades. In addition, such noise tends to easily occur around a tongue portion. Accordingly, when air is to be discharged in a plurality of directions, a deterioration in noise characteristics occurs because of an increased number of tongue portions. However, in this blower apparatus 1F, air flows traveling radially outward are generated by rotation of the flat plates 410F, and therefore, the blower apparatus 1F is able to achieve reduced periodic noise when compared to the centrifugal fan including the impeller. Therefore, the blower apparatus 1F, which is designed to discharge air in a plurality of directions, does not significantly deteriorate in noise characteristics due to the tongue portions 203F.

Note that, although the number of flat plates included in the air blowing portion is six in each of the above-described preferred embodiment and the modifications thereof, this is not essential to the present invention. The number of flat plates may alternatively be two, three, four, five, or more than six.

Also note that, although the hub is defined by two members, i.e., the hub body member and the flange member, in each of the above-described preferred embodiment and the modifications thereof, this is not essential to the present invention. The hub may alternatively be defined by a single member, or three or more members.

Also note that the detailed shape of any member may be different from the shape thereof as illustrated in the accompanying drawings of the present application. For example, the shape of any of the housing, the air blowing portion, and the motor portion may be different from that according to each of the above-described preferred embodiment and the modifications thereof. Also note that features of the above-described preferred embodiment and the modifications thereof may be combined appropriately as long as no conflict arises.

Preferred embodiments of the present invention are applicable to blower apparatuses.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A blower apparatus comprising:

an air blowing portion arranged to rotate about a central axis extending in a vertical direction;

a motor portion arranged to rotate the air blowing portion; and a housing arranged to house the air blowing portion and the motor portion; wherein the housing includes:

an air inlet arranged above the air blowing portion, and arranged to pass through a portion of the housing in an axial direction; and an air outlet arranged to face in a radial direction at least one circumferential position radially outside of the air blowing portion;

the air blowing portion includes a plurality of flat plates arranged in the axial direction with an axial gap defined between adjacent ones of the flat plates;

at least one of the flat plates includes:

an inner annular portion being annular, and centered on the central axis, and having a central hole arranged to pass therethrough in the vertical direction;

an outer annular portion being annular, centered on the central axis, and arranged radially outside of the inner annular portion;

a plurality of ribs each of which is arranged to join the inner annular portion and the outer annular portion to each other; and a plurality of air holes each of which is surrounded by the inner annular portion, the outer annular portion, and two circumferentially adjacent ones of the ribs, and is arranged to pass through the flat plate in the axial direction; and each air hole is arranged to be in communication with a space radially outside of the air blowing portion through the axial gap; and the motor portion is arranged in the central hole, wherein the ribs of the at least one flat plate are arranged at irregular intervals in a circumferential direction.

2. The blower apparatus according to claim 1, wherein a number of ribs included in each of the at least one flat plate is identical and is a prime number.

3. The blower apparatus according to claim 1, wherein the number of ribs included in each of the at least one flat plate is prime to each of a number of slots of the motor portion and a number of poles of the motor portion.

4. The blower apparatus according to claim 1, wherein the flat plates include:

a first flat plate group including one or more of the flat plates in which the ribs are arranged at predetermined first circumferential positions; and a second flat plate group including one or more of the flat plates in which the ribs are arranged at predetermined second circumferential positions different from the first circumferential positions; and the one or more of the flat plates included in the first flat plate group and the one or more of the flat plates included in the second flat plate group are arranged to alternate with each other in the axial direction.

5. The blower apparatus according to claim 1, wherein the air blowing portion is caused by the motor portion to rotate to one side in a circumferential direction;

the flat plates include:

a top flat plate arranged at a highest position of all the flat plates;

a bottom flat plate arranged at a lowest position of all the flat plates; and a plurality of intermediate flat plates arranged between the top flat plate and the bottom flat plate;

each of the top flat plate and the intermediate flat plates includes the inner annular portion, the outer annular portion, and the ribs; and the ribs of each of the intermediate flat plates are arranged to axially overlap in part with the corresponding ribs of an upwardly adjacent one of the flat plates, and are displaced to an opposite side in the circumferential direction relative to the corresponding ribs of the upwardly adjacent one of the flat plates.

6. The blower apparatus according to claim 5, wherein each rib includes, at an edge thereof on the one side in the circumferential direction, a slanting surface arranged to slant to the opposite side in the circumferential direction with decreasing height.

7. The blower apparatus according to claim 1, wherein a center of the air inlet is arranged to coincide with the central axis.

8. The blower apparatus according to claim 1, wherein the motor portion includes:

a stationary portion including an armature and a bearing housing; and a rotating portion including a shaft, a bearing member, and a magnet arranged radially opposite to the armature;

the bearing housing and a combination of the shaft and the bearing member are arranged to have a lubricating fluid therebetween;

the bearing housing and the rotating portion are arranged to together define a gap defining a seal portion therebetween, the seal portion having a surface of the lubricating fluid defined therein; and in the seal portion, a distance between the bearing housing and the rotating portion is arranged to increase with increasing distance from the surface of the lubricating fluid.

9. The blower apparatus according to claim 1, wherein the motor portion includes:

a stationary portion including an armature and a bearing housing;

a rotating portion including a shaft and a magnet arranged radially opposite to the armature; and a ball bearing arranged to connect the rotating portion to the stationary portion such that the rotating portion is rotatable with respect to the stationary portion.

10. The blower apparatus according to claim 1, wherein the housing includes a plurality of the air outlets at a plurality of circumferential positions.

11. A blower apparatus comprising:

an air blowing portion arranged to rotate about a central axis extending in a vertical direction;

a motor portion arranged to rotate the air blowing portion; and a housing arranged to house the air blowing portion and the motor portion; wherein the housing includes:

an air inlet arranged above the air blowing portion, and arranged to pass through a portion of the housing in an axial direction; and an air outlet arranged to face in a radial direction at least one circumferential position radially outside of the air blowing portion;

the air blowing portion includes a plurality of flat plates arranged in the axial direction with an axial gap defined between adjacent ones of the flat plates;

at least one of the flat plates includes:

an inner annular portion being annular, and centered on the central axis, and having a central hole arranged to pass therethrough in the vertical direction;

an outer annular portion being annular, centered on the central axis, and arranged radially outside of the inner annular portion;

a plurality of ribs each of which is arranged to join the inner annular portion and the outer annular portion to each other; and a plurality of air holes each of which is surrounded by the inner annular portion, the outer annular portion, and two circumferentially adjacent ones of the ribs, and is arranged to pass through the flat plate in the axial direction; and each air hole is arranged to be in communication with a space radially outside of the air blowing portion through the axial gap;

the motor portion is arranged in the central hole, wherein each of the ribs of each of the at least one flat plate and each of the ribs of an axially adjacent one or ones of the at least one flat plate are arranged at different circumferential positions.

* * * * *